US008225567B1

(12) United States Patent
Mollinger et al.

(10) Patent No.: US 8,225,567 B1
(45) **Date of Patent: *Jul. 24, 2012**

(54) SIDING HAVING BACKER WITH FEATURES FOR DRAINAGE, VENTILATION, AND RECEIVING ADHESIVE

(75) Inventors: Paul J. Mollinger, Blacklick, OH (US); Paul R. Pelfrey, Wheelersburg, OH (US); Larry R. Fairbanks, Columbus, OH (US)

(73) Assignee: Exterior Portfolio, LLC, Atlanta, GA (US)

( * ) Notice: Subject to any disclaimer, the term of this patent is extended or adjusted under 35 U.S.C. 154(b) by 923 days.

This patent is subject to a terminal disclaimer.

(21) Appl. No.: 11/320,169

(22) Filed: Dec. 28, 2005

Related U.S. Application Data

(63) Continuation-in-part of application No. 11/234,073, filed on Sep. 23, 2005, which is a continuation-in-part of application No. 10/688,750, filed on Oct. 17, 2003, now abandoned.

(60) Provisional application No. 60/640,158, filed on Dec. 29, 2004.

(51) Int. Cl.
*E04B 1/70* (2006.01)
*E04F 13/075* (2006.01)

(52) U.S. Cl. ..... 52/302.4; 52/309.8; 52/540; 428/159; 428/167; 428/172

(58) Field of Classification Search ..... 52/302.4, 52/309.8, 309.9, 540; 428/156, 158, 159, 428/160, 167, 172
See application file for complete search history.

(56) References Cited

U.S. PATENT DOCUMENTS

| | | | |
|---|---|---|---|
| 1,589,675 | A | 6/1926 | Belding |
| 1,728,934 | A | 9/1929 | Hogenson |
| 2,085,764 | A | 7/1937 | Odell et al. |
| 2,192,933 | A | 3/1940 | Saborsky |
| 2,264,961 | A | 12/1941 | Ward |
| 2,308,789 | A | 1/1943 | Stagg |
| 2,830,546 | A | 4/1958 | Rippe |
| 2,961,804 | A | 11/1960 | Beckman |
| 3,001,332 | A | 9/1961 | Wilder |
| 3,004,483 | A | 10/1961 | Prager et al. |
| D196,230 | S | 9/1963 | Raftery et al. |
| 3,110,130 | A | 11/1963 | Trachtenberg |
| 3,158,960 | A | 12/1964 | Etal |
| 3,159,943 | A | 12/1964 | Sugar et al. |
| 3,233,382 | A | 2/1966 | Graveley, Jr. |
| 3,246,436 | A | 4/1966 | Roush |

(Continued)

FOREIGN PATENT DOCUMENTS

| | | |
|---|---|---|
| CA | 96829 | 8/2002 |

(Continued)

OTHER PUBLICATIONS

Sweet's General Building & Renovation, 1995 Catalog File; section 07460 on Siding, pp. 4-20.

(Continued)

*Primary Examiner* — Michael Safavi
(74) *Attorney, Agent, or Firm* — Standley Law Group LLP

(57) ABSTRACT

A siding-plus-backer paneling unit that may provide a valley in the backer for improved adhesion strength, a ridge on another side of the backer for enabling ventilation, and a recess in an end of the backer for improved mating of adjacent paneling units.

7 Claims, 7 Drawing Sheets

U.S. PATENT DOCUMENTS

| | | | | | |
|---|---|---|---|---|---|
| 3,284,980 | A | | 11/1966 | Dinkel | |
| 3,289,365 | A | | 12/1966 | McLaughlin et al. | |
| 3,289,371 | A | | 12/1966 | Pearson et al. | |
| 3,289,380 | A | | 12/1966 | Charniga, Jr. | |
| 3,304,678 | A | | 2/1967 | Morell | |
| 3,308,586 | A | | 3/1967 | Olson | |
| 3,325,952 | A | | 6/1967 | Trachtenberg | |
| D208,251 | S | | 8/1967 | Facer | |
| 3,387,418 | A | | 6/1968 | Tyrer | |
| 3,399,916 | A | | 9/1968 | Ensor | |
| 3,468,086 | A | | 9/1969 | Warner | |
| 3,473,274 | A | | 10/1969 | Godes | |
| 3,520,099 | A | | 7/1970 | Mattes | |
| 3,552,078 | A | | 1/1971 | Mattes | |
| 3,555,762 | A | | 1/1971 | Costanzo, Jr. | |
| 3,608,261 | A | | 9/1971 | Etal | |
| 3,637,459 | A | | 1/1972 | Parish et al. | |
| 3,703,795 | A | | 11/1972 | Mattes | |
| 3,742,668 | A | | 7/1973 | Oliver | |
| 3,815,310 | A | | 6/1974 | Kessler | |
| 3,826,054 | A | | 7/1974 | Culpepper, Jr. | |
| 3,868,300 | A | | 2/1975 | Wheeler | |
| 3,887,410 | A | | 6/1975 | Lindner | |
| 3,895,087 | A | * | 7/1975 | Ottinger et al. | 264/46.2 |
| 3,941,632 | A | | 3/1976 | Swedenberh et al. | |
| 3,944,698 | A | | 3/1976 | Dierks et al. | |
| 3,969,866 | A | | 7/1976 | Kyne | |
| 3,970,502 | A | | 7/1976 | Turner | |
| 3,973,369 | A | | 8/1976 | Smith | |
| 3,993,822 | A | | 11/1976 | Knauf et al. | |
| 3,998,021 | A | * | 12/1976 | Lewis | 52/531 |
| 4,001,997 | A | | 1/1977 | Saltzman | |
| 4,015,391 | A | | 4/1977 | Epstein et al. | |
| 4,033,802 | A | | 7/1977 | Culpepper, Jr. et al. | |
| 4,034,528 | A | | 7/1977 | Sanders et al. | |
| 4,048,101 | A | | 9/1977 | Nakamachi et al. | |
| 4,065,333 | A | | 12/1977 | Lawlis et al. | |
| 4,073,997 | A | | 2/1978 | Richards et al. | |
| 4,081,939 | A | | 4/1978 | Culpepper, Jr. et al. | |
| 4,096,011 | A | * | 6/1978 | Sanders et al. | 156/196 |
| 4,100,711 | A | | 7/1978 | Skuran | |
| 4,102,106 | A | | 7/1978 | Golder et al. | |
| 4,104,841 | A | | 8/1978 | Naz | |
| 4,109,041 | A | | 8/1978 | Tellman | |
| 4,118,166 | A | | 10/1978 | Bartrum | |
| 4,154,040 | A | | 5/1979 | Pace | |
| 4,181,767 | A | | 1/1980 | Steinau | |
| 4,188,762 | A | | 2/1980 | Tellman | |
| 4,189,885 | A | | 2/1980 | Fritz | |
| 4,242,406 | A | | 12/1980 | Bouhnini et al. | |
| 4,272,576 | A | | 6/1981 | Britson | |
| 4,274,236 | A | | 6/1981 | Kessler | |
| 4,277,526 | A | * | 7/1981 | Jackson | 428/31 |
| 4,279,106 | A | | 7/1981 | Gleason et al. | |
| 4,288,959 | A | | 9/1981 | Murdock | |
| 4,296,169 | A | | 10/1981 | Shannon | |
| 4,303,722 | A | | 12/1981 | Pilgrim | |
| 4,319,439 | A | | 3/1982 | Gussow | |
| 4,320,613 | A | | 3/1982 | Kaufman | |
| 4,327,528 | A | | 5/1982 | Fritz | |
| 4,335,177 | A | | 6/1982 | Takeuchi | |
| 4,351,867 | A | | 9/1982 | Mulvey et al. | |
| 4,352,771 | A | | 10/1982 | Szabo | |
| 4,361,616 | A | | 11/1982 | Bomers | |
| 4,366,197 | A | | 12/1982 | Hanlon et al. | |
| 4,389,824 | A | | 6/1983 | Anderson | |
| 4,399,643 | A | | 8/1983 | Hafner | |
| 4,424,655 | A | | 1/1984 | Trostle | |
| 4,429,503 | A | | 2/1984 | Holliday | |
| 4,437,274 | A | | 3/1984 | Slocum et al. | |
| 4,450,665 | A | | 5/1984 | Katz | |
| D274,947 | S | | 7/1984 | Culpepper, Jr. et al. | |
| 4,468,909 | A | | 9/1984 | Eaton | |
| 4,477,300 | A | | 10/1984 | Pilgrim | |
| 4,492,064 | A | | 1/1985 | Bynoe | |
| 4,504,533 | A | | 3/1985 | Altenhofer et al. | |
| 4,506,486 | A | | 3/1985 | Culpepper, Jr. et al. | |
| 4,586,304 | A | | 5/1986 | Flamand | |
| 4,593,512 | A | | 6/1986 | Funaki | |
| 4,608,800 | A | | 9/1986 | Fredette | |
| 4,637,860 | A | | 1/1987 | Harper et al. | |
| 4,647,496 | A | | 3/1987 | Lehnert | |
| 4,649,008 | A | | 3/1987 | Johnstone et al. | |
| 4,680,911 | A | | 7/1987 | Davis et al. | |
| D291,249 | S | | 8/1987 | Manning | |
| 4,694,628 | A | | 9/1987 | Vondergoltz et al. | |
| 4,709,519 | A | | 12/1987 | Liefer et al. | |
| 4,716,645 | A | | 1/1988 | Pittman et al. | |
| 4,722,866 | A | | 2/1988 | Wilson et al. | |
| 4,782,638 | A | | 11/1988 | Hovind | |
| 4,788,808 | A | | 12/1988 | Slocum | |
| 4,810,569 | A | | 3/1989 | Lehnert et al. | |
| 4,814,413 | A | | 3/1989 | Thibaut et al. | |
| 4,843,790 | A | | 7/1989 | Taravella | |
| 4,856,975 | A | | 8/1989 | Gearhart | |
| 4,864,788 | A | | 9/1989 | Tippmann | |
| 4,911,628 | A | | 3/1990 | Heilmayr et al. | |
| 4,920,709 | A | | 5/1990 | Garries et al. | |
| 4,930,287 | A | | 6/1990 | Volk et al. | |
| 4,955,169 | A | | 9/1990 | Shisko | |
| 4,962,622 | A | | 10/1990 | Albrecht et al. | |
| 4,969,302 | A | * | 11/1990 | Coggan et al. | 52/309.8 |
| D316,299 | S | | 4/1991 | Hurlburt | |
| 5,016,415 | A | | 5/1991 | Kellis | |
| 5,022,204 | A | | 6/1991 | Anderson | |
| 5,022,207 | A | | 6/1991 | Hartnett | |
| 5,024,045 | A | | 6/1991 | Fluent et al. | |
| 5,050,357 | A | | 9/1991 | Lawson | |
| 5,060,426 | A | | 10/1991 | Jantzen | |
| 5,060,444 | A | | 10/1991 | Paquette | |
| 5,080,950 | A | | 1/1992 | Burke | |
| 5,090,174 | A | | 2/1992 | Fragale | |
| 5,094,058 | A | | 3/1992 | Slocum | |
| 5,103,612 | A | | 4/1992 | Wright | |
| 5,220,762 | A | | 6/1993 | Lehnert et al. | |
| 5,224,315 | A | | 7/1993 | Winter, IV | |
| 5,230,377 | A | | 7/1993 | Berman | |
| D342,579 | S | | 12/1993 | Mason | |
| 5,282,344 | A | | 2/1994 | Moore | |
| 5,283,102 | A | * | 2/1994 | Sweet et al. | 428/167 |
| 5,303,525 | A | | 4/1994 | Magee | |
| 5,306,548 | A | | 4/1994 | Zabrocki et al. | |
| 5,318,737 | A | | 6/1994 | Trabert et al. | |
| 5,319,900 | A | | 6/1994 | Lehnert et al. | |
| 5,347,784 | A | | 9/1994 | Crick et al. | |
| 5,353,560 | A | * | 10/1994 | Heydon | 52/281 |
| 5,363,623 | A | | 11/1994 | King | |
| 5,371,989 | A | | 12/1994 | Lehnert et al. | |
| 5,387,381 | A | | 2/1995 | Saloom | |
| 5,394,672 | A | | 3/1995 | Seem | |
| 5,415,921 | A | | 5/1995 | Grohman | |
| D361,138 | S | | 8/1995 | Moore et al. | |
| 5,443,878 | A | | 8/1995 | Treloar et al. | |
| 5,461,839 | A | | 10/1995 | Beck | |
| 5,465,486 | A | | 11/1995 | King | |
| 5,465,543 | A | | 11/1995 | Seifert | |
| 5,475,963 | A | | 12/1995 | Chelednik | |
| 5,482,667 | A | | 1/1996 | Dunton et al. | |
| 5,501,056 | A | | 3/1996 | Hannah et al. | |
| 5,502,940 | A | * | 4/1996 | Fifield | 52/309.12 |
| 5,522,199 | A | * | 6/1996 | Pearce | 52/749.1 |
| 5,537,791 | A | | 7/1996 | Champagne | |
| 5,542,222 | A | | 8/1996 | Wilson et al. | |
| 5,548,940 | A | | 8/1996 | Baldock | |
| 5,551,204 | A | | 9/1996 | Mayrand | |
| 5,560,170 | A | | 10/1996 | Ganser et al. | |
| 5,564,246 | A | | 10/1996 | Champagne | |
| 5,565,056 | A | | 10/1996 | Lause et al. | |
| 5,575,127 | A | | 11/1996 | O'Neal | |
| 5,581,970 | A | | 12/1996 | O'Shea | |
| 5,586,415 | A | | 12/1996 | Fisher et al. | |
| 5,598,677 | A | | 2/1997 | Rehm, III | |
| 5,601,888 | A | | 2/1997 | Fowler | |
| 5,613,337 | A | | 3/1997 | Plath et al. | |
| 5,622,020 | A | | 4/1997 | Wood | |
| 5,634,314 | A | | 6/1997 | Champagne | |
| 5,636,489 | A | | 6/1997 | Leverrier et al. | |

| | | | | |
|---|---|---|---|---|
| 5,644,880 | A | 7/1997 | Lehnert et al. | |
| 5,651,227 | A | 7/1997 | Anderson | |
| 5,661,939 | A | 9/1997 | Coulis et al. | |
| 5,662,977 | A | 9/1997 | Spain et al. | |
| 5,664,376 | A | 9/1997 | Wilson et al. | |
| 5,671,577 | A | 9/1997 | Todd | |
| 5,675,955 | A | 10/1997 | Champagne | |
| 5,678,367 | A | 10/1997 | Kline | |
| 5,694,728 | A | 12/1997 | Heath, Jr. et al. | |
| 5,704,172 | A | 1/1998 | Gougeon et al. | |
| 5,704,179 | A | 1/1998 | Lehnert et al. | |
| 5,720,114 | A | 2/1998 | Guerin | |
| 5,729,946 | A | 3/1998 | Beck | |
| 5,737,881 | A | 4/1998 | Stocksieker | |
| 5,765,333 | A | 6/1998 | Cunningham | |
| 5,768,844 | A | 6/1998 | Grace, Sr. et al. | |
| 5,772,846 | A | 6/1998 | Jaffee | |
| 5,784,848 | A | 7/1998 | Toscano | |
| 5,791,093 | A | 8/1998 | Diamond | |
| 5,791,109 | A | 8/1998 | Lehnert et al. | |
| 5,799,446 | A | 9/1998 | Tamlyn | |
| 5,806,185 | A | 9/1998 | King | |
| 5,809,731 | A | 9/1998 | Reiss | |
| 5,829,206 | A | 11/1998 | Bachman | |
| 5,836,113 | A | 11/1998 | Bachman | |
| D402,770 | S | 12/1998 | Hendrickson et al. | |
| 5,857,303 | A | 1/1999 | Beck et al. | |
| 5,858,522 | A | 1/1999 | Turk et al. | |
| 5,860,259 | A | 1/1999 | Laska | |
| 5,866,054 | A | 2/1999 | Dorchester et al. | |
| 5,866,639 | A | 2/1999 | Dorchester et al. | |
| 5,869,176 | A | 2/1999 | Dorchester et al. | |
| 5,878,543 | A | 3/1999 | Mowery | |
| 5,881,502 | A | 3/1999 | Tamlyn | |
| 5,945,182 | A | 8/1999 | Fowler et al. | |
| 5,946,876 | A | 9/1999 | Grace, Sr. et al. | |
| 5,956,914 | A | 9/1999 | Williamson | |
| 5,974,756 | A | 11/1999 | Alvarez et al. | |
| 5,981,406 | A | 11/1999 | Randall | |
| 6,018,924 | A | 2/2000 | Tamlyn | |
| 6,029,415 | A | 2/2000 | Culpepper et al. | |
| 6,035,587 | A | 3/2000 | Dressler | |
| 6,047,507 | A | 4/2000 | Lappin et al. | |
| 6,050,041 | A | 4/2000 | Mowery et al. | |
| 6,086,997 | A | 7/2000 | Patel et al. | |
| D429,009 | S | 8/2000 | Ginzel | |
| 6,122,877 | A | 9/2000 | Hendrickson et al. | |
| 6,161,354 | A | 12/2000 | Gilbert et al. | |
| 6,185,891 | B1 | 2/2001 | Moore | |
| 6,187,424 | B1 | 2/2001 | Kjellqvist et al. | |
| 6,195,952 | B1 * | 3/2001 | Culpepper et al. | 52/522 |
| 6,223,488 | B1 | 5/2001 | Pelfrey et al. | |
| 6,228,507 | B1 * | 5/2001 | Hahn | 428/542.2 |
| 6,233,890 | B1 | 5/2001 | Tonyan | |
| 6,263,574 | B1 | 7/2001 | Lubker, II et al. | |
| 6,272,797 | B1 | 8/2001 | Finger | |
| 6,276,107 | B1 | 8/2001 | Waggoner et al. | |
| D447,820 | S | 9/2001 | Grace | |
| 6,282,858 | B1 | 9/2001 | Swick | |
| D448,865 | S | 10/2001 | Manning | |
| 6,295,777 | B1 | 10/2001 | Hunter et al. | |
| D450,138 | S | 11/2001 | Barber | |
| 6,321,500 | B1 | 11/2001 | Manning et al. | |
| 6,336,988 | B1 | 1/2002 | Enlow et al. | |
| 6,348,512 | B1 | 2/2002 | Adriani | |
| D454,962 | S | 3/2002 | Grace | |
| 6,358,585 | B1 | 3/2002 | Wolff | |
| 6,360,508 | B1 | 3/2002 | Pelfrey et al. | |
| 6,363,676 | B1 | 4/2002 | Martion, III | |
| 6,367,220 | B1 | 4/2002 | Krause et al. | |
| 6,367,222 | B1 | 4/2002 | Timbrel et al. | |
| 6,393,792 | B1 | 5/2002 | Mowery et al. | |
| 6,418,610 | B2 | 7/2002 | Lubker, II et al. | |
| 6,442,912 | B1 | 9/2002 | Phillips et al. | |
| 6,516,577 | B2 | 2/2003 | Pelfrey et al. | |
| 6,516,578 | B1 * | 2/2003 | Hunsaker | 52/387 |
| D471,292 | S | 3/2003 | Barber | |
| 6,526,718 | B2 | 3/2003 | Manning et al. | |
| 6,539,675 | B1 | 4/2003 | Gile | |
| 6,594,965 | B2 | 7/2003 | Coulton | |
| 6,625,939 | B1 | 9/2003 | Beck et al. | |
| D481,804 | S | 11/2003 | Pelfrey | |
| 6,673,868 | B2 | 1/2004 | Choulet | |
| 6,684,597 | B1 | 2/2004 | Butcher | |
| 6,716,522 | B2 | 4/2004 | Matsumoto et al. | |
| 6,752,941 | B2 | 6/2004 | Hills | |
| 6,784,230 | B1 | 8/2004 | Patterson et al. | |
| 6,824,850 | B2 | 11/2004 | Nourigat | |
| 6,865,849 | B1 | 3/2005 | Mollinger et al. | |
| 6,886,301 | B2 | 5/2005 | Schilger | |
| 6,971,211 | B1 | 12/2005 | Zehner | |
| 6,979,189 | B2 | 12/2005 | Baxter et al. | |
| 6,988,345 | B1 | 1/2006 | Pelfrey et al. | |
| 7,040,067 | B2 | 5/2006 | Mowery et al. | |
| 7,188,454 | B2 | 3/2007 | Mowery et al. | |
| 7,204,062 | B2 | 4/2007 | Fairbanks | |
| 7,281,358 | B2 | 10/2007 | Floyd | |
| 7,331,150 | B2 | 2/2008 | Martinique | |
| 7,467,500 | B2 | 12/2008 | Fairbanks et al. | |
| 7,908,814 | B2 | 3/2011 | Wilson et al. | |
| 2001/0023565 | A1 | 9/2001 | Snider et al. | |
| 2001/0041256 | A1 | 11/2001 | Heilmayr | |
| 2002/0018907 | A1 | 2/2002 | Zehner | |
| 2002/0020125 | A1 | 2/2002 | Pelfrey et al. | |
| 2002/0025420 | A1 | 2/2002 | Wanat et al. | |
| 2002/0029537 | A1 | 3/2002 | Manning et al. | |
| 2002/0054996 | A1 | 5/2002 | Rheenen | |
| 2002/0056244 | A1 | 5/2002 | Hertweck | |
| 2002/0076544 | A1 | 6/2002 | DeWorth et al. | |
| 2002/0078650 | A1 | 6/2002 | Bullinger et al. | |
| 2002/0090471 | A1 | 7/2002 | Burger et al. | |
| 2002/0108327 | A1 | 8/2002 | Shaw | |
| 2002/0177658 | A1 | 11/2002 | Tajima et al. | |
| 2002/0189182 | A1 * | 12/2002 | Record | 52/309.9 |
| 2003/0014936 | A1 | 1/2003 | Watanabe | |
| 2003/0024192 | A1 | 2/2003 | Spargur | |
| 2003/0029097 | A1 | 2/2003 | Albracht | |
| 2003/0056458 | A1 | 3/2003 | Black et al. | |
| 2003/0121225 | A1 * | 7/2003 | Hunsaker | 52/314 |
| 2003/0131551 | A1 | 7/2003 | Mollinger et al. | |
| 2003/0154664 | A1 | 8/2003 | Beck et al. | |
| 2004/0003566 | A1 | 1/2004 | Sicuranza | |
| 2004/0026021 | A1 | 2/2004 | Groh et al. | |
| 2004/0142157 | A1 | 7/2004 | Melkonian | |
| 2004/0211141 | A1 | 10/2004 | Sandy | |
| 2005/0081468 | A1 * | 4/2005 | Wilson et al. | 52/528 |
| 2006/0005492 | A1 | 1/2006 | Yohnke et al. | |
| 2006/0026920 | A1 | 2/2006 | Fairbanks et al. | |
| 2006/0037268 | A1 | 2/2006 | Mahaffey | |
| 2006/0042183 | A1 | 3/2006 | Benes | |
| 2006/0053715 | A1 | 3/2006 | Mowery et al. | |
| 2006/0053716 | A1 | 3/2006 | Mowery et al. | |
| 2006/0053740 | A1 * | 3/2006 | Wilson et al. | 52/745.09 |
| 2006/0068188 | A1 | 3/2006 | Morse et al. | |
| 2006/0075712 | A1 | 4/2006 | Gilbert et al. | |
| 2006/0156668 | A1 * | 7/2006 | Nasvik | 52/516 |
| 2007/0011976 | A1 | 1/2007 | Mowery et al. | |
| 2007/0044402 | A1 | 3/2007 | Hess | |
| 2011/0154759 | A1 | 6/2011 | Wilson et al. | |

FOREIGN PATENT DOCUMENTS

| | | | |
|---|---|---|---|
| CA | 2267000 | | 4/2003 |
| CL | 3.856 | | 5/2001 |
| DE | 40104760.1 | | 5/2001 |
| EP | 1086988 | A1 | 3/2001 |
| GB | 1068202 | | 5/1967 |
| GB | 2101944 | | 8/2001 |
| JP | 364001539 | A | 1/1989 |
| JP | 2141484 | A | 5/1990 |
| JP | 4189938 | | 7/1992 |
| JP | 5147997 | A | 6/1993 |
| JP | 6008219 | A | 1/1994 |
| JP | 409141752 | A | 6/1997 |
| JP | 410018555 | A | 1/1998 |
| JP | 02001079951 | A | 3/2001 |
| KR | 321694 | | 3/2003 |
| PL | 4115 | | 7/2004 |
| WO | 9957392 | A1 | 11/1999 |

| | | | |
|---|---|---|---|
| WO | WO 00/55446 | A1 | 9/2000 |
| WO | 02070248 | A1 | 9/2002 |
| WO | 02081399 | | 10/2002 |

OTHER PUBLICATIONS

"New Craneboard solid core siding redefines home exterior siding," Crane Performance Siding news release online, Mar. 20, 2001, 3 pages.

Jim Weiker, "Crane puts new face on siding," The Columbus Dispatch, May 9, 2002, 3 pages.

Crane in the News, International Builders' Show Preview, Jan./Feb. 2003, 1 page.

Dupont Dow, "Adhesives", web site print outs from www.dupontdow.com, 1999, printed Aug. 12, 2000, 3 pages.

Dupont Dow, "Neoprene—Grades of Neoprene—AquaStikTM Water Based Polychloroprene.", web site print outs from www.dupontdow.com, 1999, printed Aug. 12, 2000, 2 pages.

Dupont Dow, "Neoprene—Grades of Neoprene—Neoprene Solid Grades for Solvent-Based Adhesives.", web site print outs from www.dupontdow.com, publication date not available, printed Aug. 12, 2000, 2 pages.

Owens Corning, Innovations for Living, "What Do I Look For in Quality Vinyl Siding?", 1996-2002, printed Nov. 9, 2002, 1 page.

Web site print outs from: www.new-siding.com (Jul. 7, 2005 archived website).

* cited by examiner

SIDING HAVING BACKER WITH FEATURES FOR DRAINAGE, VENTILATION, AND RECEIVING ADHESIVE

This application claims the priority benefit of U.S. Provisional Application No. 60/640,158, filed Dec. 29, 2004, which is hereby incorporated by reference in its entirety. This application is also a continuation-in-part of U.S. application Ser. No. 11/234,073, filed Sep. 23, 2005, which is a continuation-in-part of U.S. application Ser. No. 10/688,750, now abandoned, filed Oct. 17, 2003, each of which is also hereby incorporated by reference in its entirety.

BACKGROUND AND SUMMARY OF THE INVENTION

The present invention relates generally to panels, such as vinyl siding, cellulosic composite siding, and fiber cement siding, and more particularly to panels having backers applied thereto, such backers for example comprising foam material. Examples of panels that may benefit from the present invention include siding panels, wall panels, and other similar, suitable, or conventional types of panels for building structures.

This application incorporates by reference U.S. Pat. No. 6,321,500 as background for the present application. By way of background, in order to enhance the thermal insulation of building structures, it is known to provide one or more layers or panels of insulating material between the vinyl facing panel and the building structure. The backing may also improve the structural characteristics of the siding panel. Known insulated siding systems exist in many different forms. For instance, it is known to nail large sheets of insulating material to the building structure and then install the siding over the insulating material. Another system places a panel of insulation material in a slot behind the vinyl facing panel. Yet another system pours foam filler into the back of a vinyl facing panel such that the foam filler conforms to the geometry of the vinyl facing panel.

The present invention provides an improved backer for use with panels. Exemplary embodiments of the present invention may include one or more new features not present in prior backers.

First, one or more "valleys" or recesses may be formed in a first side of the backer which adheres to the siding. These valleys may be useful for providing increased surface area in which glue or other adhesive can flow and thereby increase the adhesion strength of the backer to the siding panel.

Second, one or more ridges may be formed in a second side of the backer which is facing the wall of a building structure upon which the siding is being applied. The ridges may protrude slightly from the second side of the backer to create ventilation space between the non-ridged areas of the second side of the backer and the wall. Providing for ventilation may help to prevent or limit any accumulation of moisture between the wall and the backer.

Third, a mating recess may be formed in an end of the backer so that an adjacent siding panel with backer can be overlapped more easily. In this manner, better fitting seams may be formed between adjacent panels.

The present invention may be an improvement over known backing systems. One exemplary embodiment of the present invention may provide a siding unit, which is comprised of backing and a facing panel. Some of the advantages of the backed siding may include improved energy efficiency, reduced air infiltration, reduced curvature in the siding panels, and increased ease of installation. In addition, one embodiment of the backed siding of the present invention may have improved interlocking pieces and improved backing.

In addition to the novel features and advantages mentioned above, other features and advantages of the present invention will be readily apparent from the following descriptions of the drawings and exemplary embodiments.

DETAILED DESCRIPTION OF EXEMPLARY EMBODIMENT(S)

Figure 1:
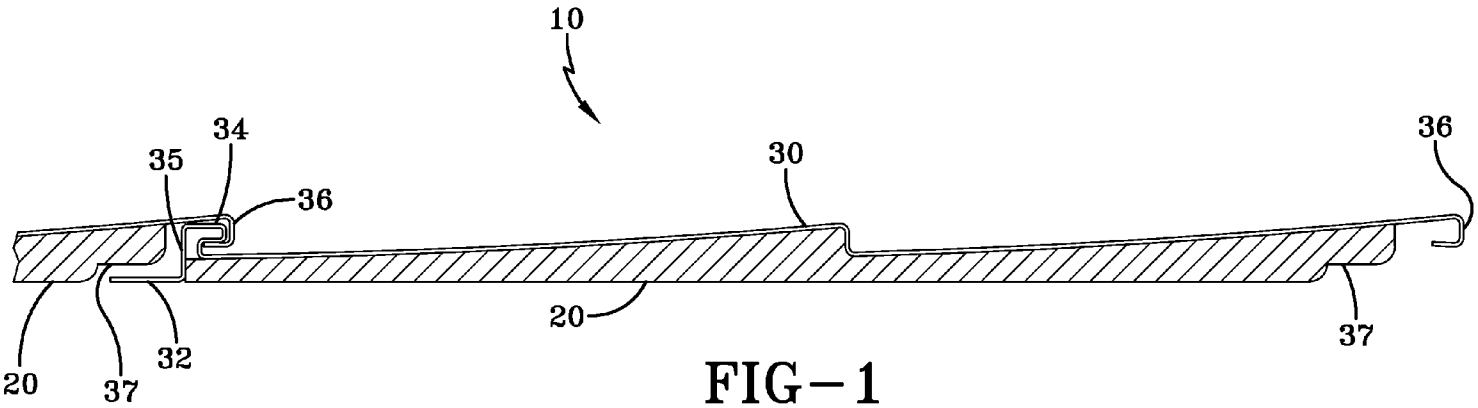
FIG. 1 is a side elevation view of an assembly including a first backed siding unit.
Figure 2:
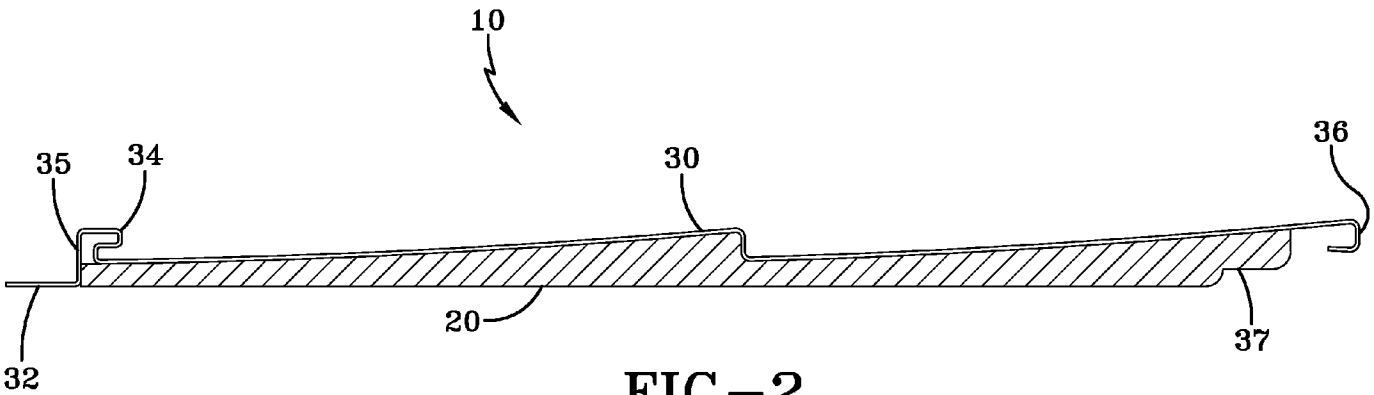
FIG. 2 is a side elevation view of the siding unit shown in FIG. 1.

The present invention is directed to a backed paneling unit. FIGS. 1 through 11 illustrate exemplary embodiments of a paneling unit that may incorporate features of the present invention. FIGS. 1 and 2 show a siding unit 10 with two rows of siding. Nevertheless, it should be understood that a paneling unit of the present invention may be manufactured with any desired number of rows.

In FIGS. 1 and 2, the siding unit 10 includes backing portion 20 ("backer") and at least one facing or cover panel or portion 30 ("siding panel"). For example, the backing portion 20 may be comprised of a base of either expanded or extruded polystyrene foam. However, it should be recognized that the backing portion 20 may be comprised of any sufficiently rigid material, including, but not limited to, foam, fiberglass, cardboard, and other similar, suitable, or conventional materials. Any suitable means may be used to obtain the shape of the backing portion 20. In an exemplary embodiment, the shape of the backing portion 20 may be obtained by extrusion through a predetermined die configuration and/or by cutting such as with a power saw or other cutting devices.

The backing portion 20 may be glued or otherwise laminated or adhered to the inside of the cover panel 30. For example, an adhesive may be used to bond a portion of a backed portion 20 to a portion of the inside of a facing panel 30.

In addition, the facing portion 30 may include an attachment strip 32 (e.g., a nailing strip), a tongue 34, and a groove 36. The facing panel 30 of the present invention has a portion 35 that rearwardly extends to attachment strip 32. The portion 35, alone or in combination with attachment strip 32, substantially covers the end or tip of the backing portion 20. More particularly, the portion 35 wraps around and abuts or is substantially adjacent to the end or tip of the backing portion 20. As a result, the portion 35 protects the end or tip of the backing portion 20 from damage, particularly during shipping and installation. In this example, the attachment strip 32 is substantially in the same plane and parallel to an adjacent portion of the rear side of the backing portion 20. A channel 37 on the bottom portion of the backing portion 20 may be adapted to interlock with, overlap, and/or extend over the nailing strip 32 of the facing panel 30 of a substantially similar siding unit 10. The nailing strip (also called a nailing hem) 32 may have a plurality of openings for receiving fasteners. Nails or any other suitable mechanical fastening means may be extended through apertures in the nailing strip 32 in order to secure the facing panel 30 to a building structure. As is shown in FIG. 1, the tongue 34 is adapted to fit in the groove 36 of another siding panel when installed on a building structure. Likewise, the groove 36 is adapted to receive the tongue 34 of a substantially similar siding panel when installed on a building structure. The tongue-and-groove connection may also be referred to as a hanger section.

The top or face portion of the siding unit 10 may have a facing panel 30, which completely covers the backing portion 20. A benefit of this feature is that the backing portion 20 is protected from breakage that may occur in shipping, handling, or installation if not substantially covered with a facing panel 30.

Figure 3:
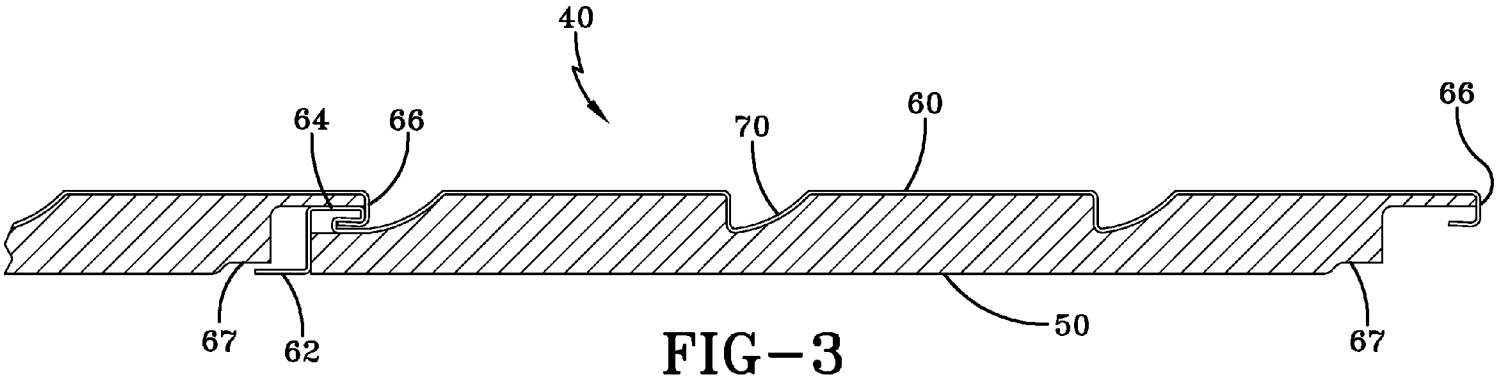
FIG. 3 is a side elevation view of an assembly including a second siding unit.

FIG. 3 shows an embodiment of a siding unit 40 in which the backing portion 50 extends into the groove 66. The tongue 64 is adapted to fit into the groove 66 of an adjacent siding unit. The unit also has a nailing hem 62, which may or may not have an aperture for fastening the siding unit down. A channel 67 on the bottom portion of the backing portion 50 is adapted to interlock with, overlap, and/or cover the nailing strip 62 of the facing panel 60 of a substantially similar siding unit 40.

In FIGS. 3 through 6, the facing panels 60, 100, 140, and 180, respectively, have flat top surfaces that are substantially parallel to the structure on which the paneling unit is adapted to be installed. In these examples, the facing panels have regularly space indentures or recessed portions 70, 110, 150, and 190, respectively.

Figure 4:
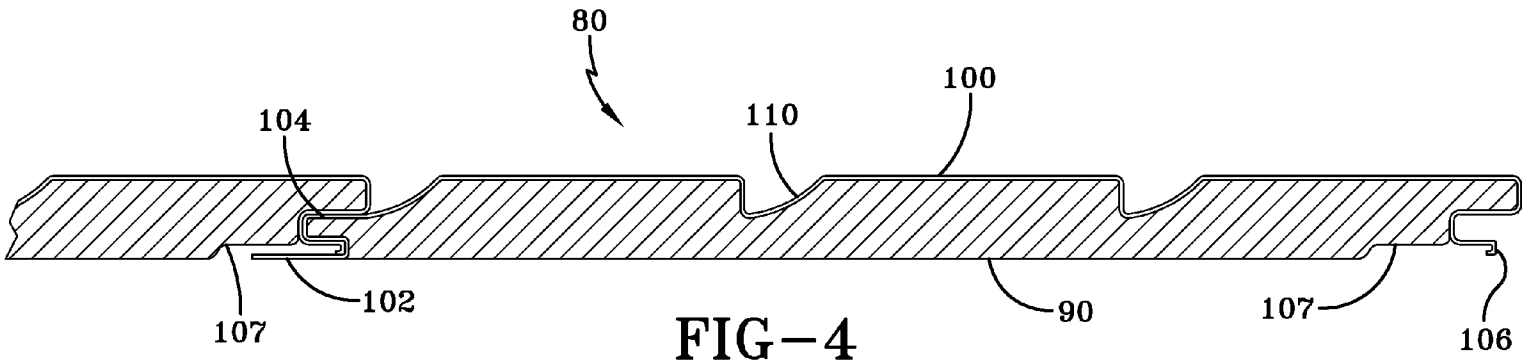
FIG. 4 is a side elevation view of an assembly including a third siding unit.

FIG. 4 shows an embodiment of a wall panel unit. The siding unit 80 has a backing portion 90 and a facing panel 100. The facing panel 100 includes an attachment strip or hem 102, a tongue 104, and a groove 106. In this embodiment, the facing panel 100 substantially covers the top end or tip and the bottom end or tip of the backing portion 90. The tongue 104 extends around and abuts or is substantially adjacent to the top end or tip of the backing portion 90. Also, the groove 106 wraps around and abuts or is substantially adjacent to the bottom end or tip of the backing portion 90. A terminal portion of the groove 106 extends away from a channel 107 on the rear side of the bottom portion of the backing portion 90. The channel 107 may be adapted to interlock with, overlap, and/or extend over the nailing strip 102 of the facing panel 100 of a substantially similar siding unit 80. The channel 107 may provide a sufficient amount of clearance for the top of a mechanical fastener such as a nail, which may extend through the nailing strip 102 of an adjacent siding unit 80.

Figure 5:
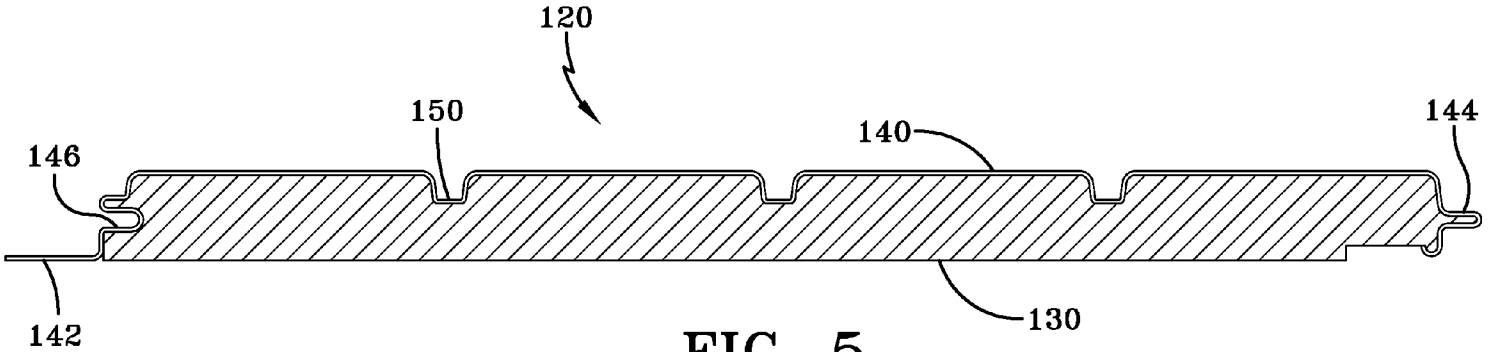
FIG. 5 is a side elevation view of a wall panel unit.

FIG. 5 represents an exemplary embodiment of a wall panel unit 120. The paneling unit 120 has a backing portion 130 and a facing panel 140. The facing panel 140 includes an attachment strip or hem 142, a tongue 144, and a groove 146. This embodiment of the facing panel 140 also substantially covers the top end or tip and the bottom end or tip of the backing portion 130. In this example, the tongue 144 extends around and abuts or is substantially adjacent to the bottom end or tip of the backing portion 130, and the groove 146 wraps around and abuts or is substantially adjacent to the top end or tip of the backing portion 130. A terminal portion of the facing panel 140 may extend around the bottom end or tip of the backing portion 130 and into a channel on the rear side of the bottom portion of the backing portion 130. The channel may be adapted to interlock with, overlap, and/or extend over the nailing strip 142 of the facing panel 140 of a substantially similar paneling unit 120. The channel may provide a sufficient amount of clearance for the top of a mechanical fastener such as a nail, which may extend through the nailing strip 142 of an adjacent paneling unit 120.

Figure 6:
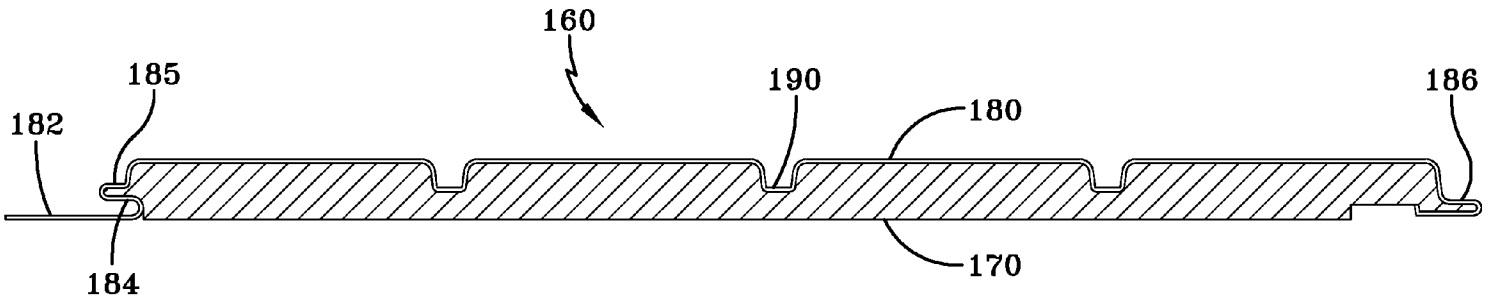
FIG. 6 is a side elevation view of another wall panel unit.

FIG. 6 shows an embodiment of a paneling unit 160 that may incorporate the features of the present invention. The paneling unit 160 has a backing portion 170 and a facing panel 180. The facing panel 180 includes an attachment strip or hem 182, a groove 184, a tongue 185, and another tongue 186. This is another embodiment in which the facing panel 180 substantially covers the top end or tip and the bottom end or tip of the backing portion 170. In this example, the groove 184 is formed between the nailing strip 182 and the tongue 185. Both the groove 184 and the tongue 185 abut or are substantially adjacent to the top end or tip of the backing portion 170. On the other hand, the tongue 186 extends around and abuts or is substantially adjacent to the bottom end or tip of the backing portion 170. As shown in the example, a channel may be formed on the rear side of the bottom portion of the backing portion 170. The channel may be adapted to interlock with, overlap, and/or extend over the nailing strip 182 of the facing panel 180 of a substantially similar paneling unit 160. The channel may provide a sufficient amount of clearance for the top of a mechanical fastener such as a nail, which may extend through the nailing strip 182 of an adjacent paneling unit 160. Optionally, the facing panel 180 may extend around the bottom end or tip of the backing portion 130 and into the channel.

Figure 7:
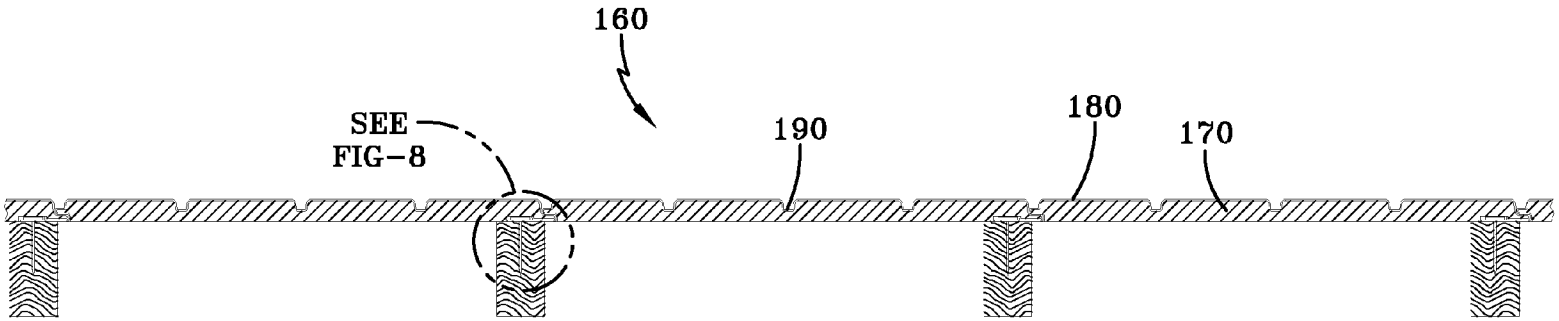
FIG. 7 is a cross-sectional view of an assembly of paneling units of FIG. 6.
Figure 8:
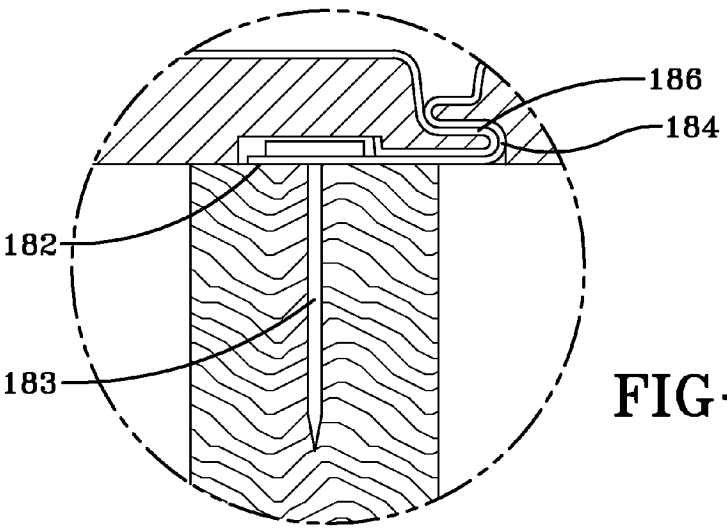
FIG. 8 is a cross-sectional view of a designated portion of FIG. 7.

The paneling unit of FIG. 6 is adapted to be connected to adjacent, substantially similar paneling units as shown in FIG. 7. A designated portion of FIG. 7 is shown in FIG. 8. The tongue 186 of one paneling unit is situated in the groove 184 of an adjacent paneling unit. A fastener 183 is shown in an aperture of the nailing strip or hem 182.

Figure 9:
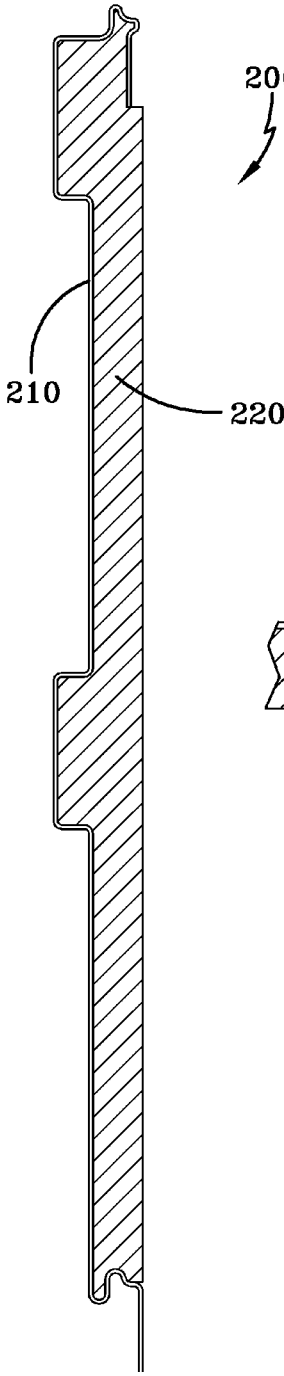
FIG. 9 is a side elevation view of a third wall panel unit.
Figure 10:
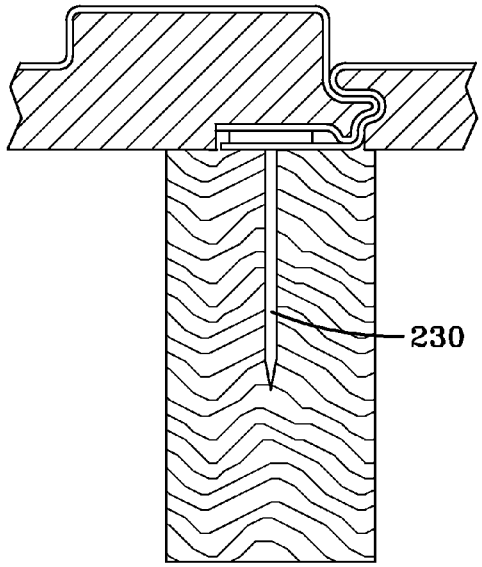
FIG. 10 is a partial side elevation view of an assembly including the paneling units shown in FIG. 9.
Figure 11:
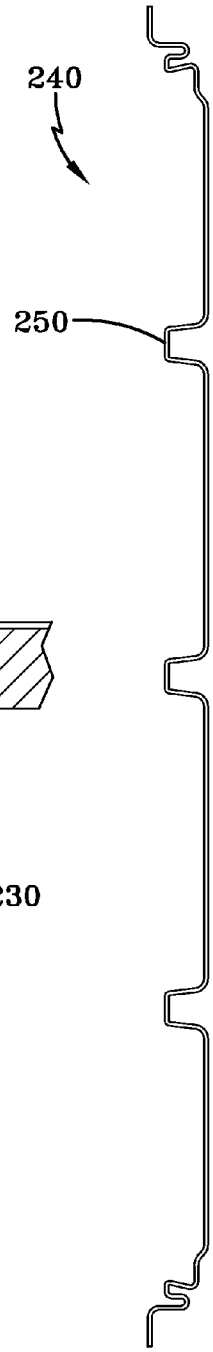
FIG. 11 is a side elevation view of a fourth wall panel unit.

FIGS. 9 through 11 illustrate some other embodiments of paneling units that may incorporate the present invention. FIG. 9 shows a wall panel unit 200 that is comprised of a facing panel 210 and a backing portion 220. FIG. 10 shows a fastener 230 connecting adjacent paneling units 200 together. A wall panel unit 240 comprising a facing panel 250 is shown in FIG. 11. It should be recognized that the wall panel unit 240 may include a backing portion.

Figure 12:
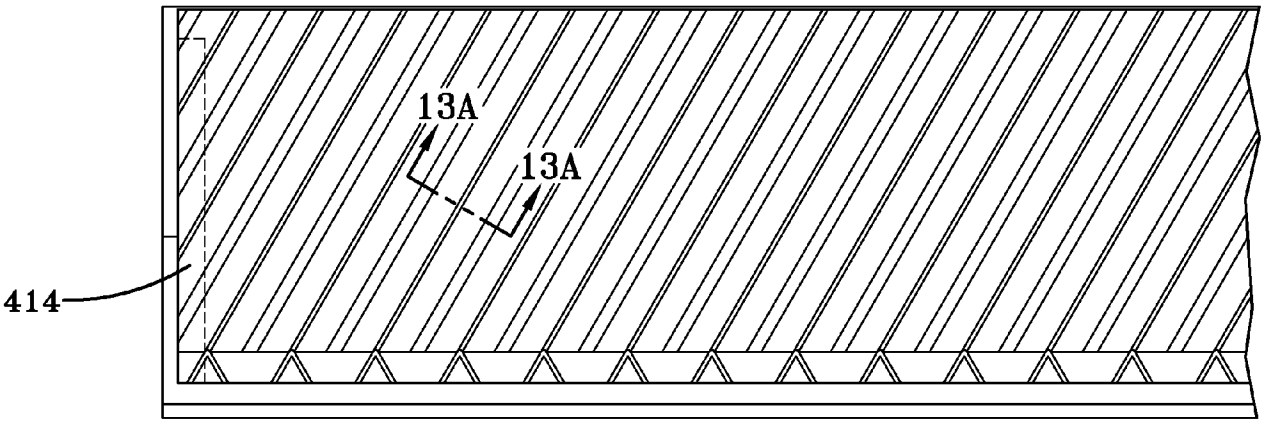
FIG. 12 is a rear elevation view of an exemplary embodiment of a paneling unit of the present invention.
Figure 13B:
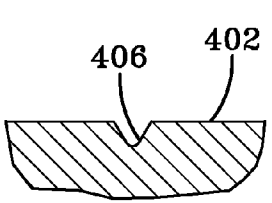
FIG. 13B is a partial sectional view of the first side of the backer of FIG. 12, more clearly showing features of an exemplary embodiment of the present invention.
Figure 13A:
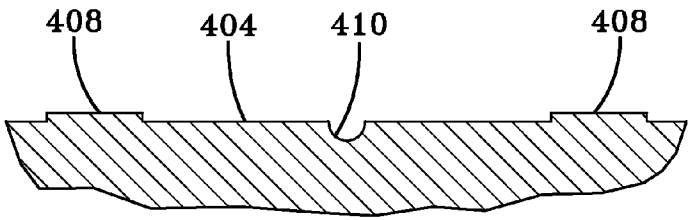
FIG. 13A is a sectional view taken along section 13A-13A of FIG. 12, more clearly showing features of an exemplary embodiment of the present invention.
Figure 14:
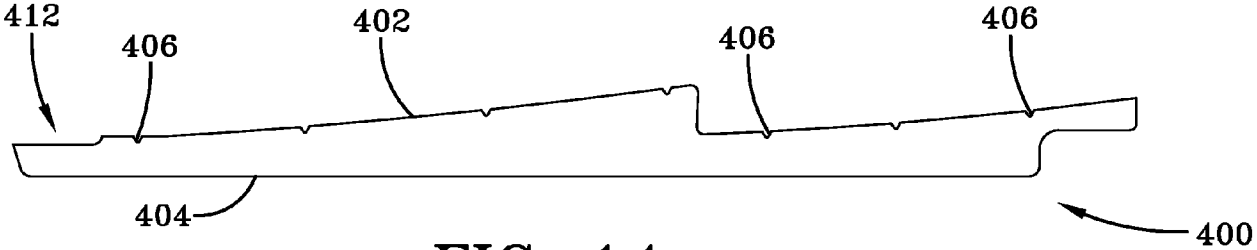
FIG. 14 is a side elevation view of an exemplary embodiment of a backer for a paneling unit of the present invention.

FIGS. 12 through 15 show the three features of one exemplary embodiment of the present invention as may be incorporated into any of the above described paneling units. As shown in FIG. 14, a backer 400 is comprised of a first side 402 to be applied to a siding portion and a second side 404 to be applied to a wall of a structure. In the first side 402 there are formed grooves or valleys 406 for receiving adhesive when the lamination step is performed to unite the siding cover portion to the backer portion of the paneling unit. The valleys can be practically any cross section shape. In an exemplary embodiment the valleys may be "v" shaped grooves of about 0.1016 inch radius curvature and about 0.0625 inch depth. Larger or smaller grooves of various shapes are within the scope of the present invention. The valleys may be formed in the backer at the same time the backer is formed, from a mold for example. By providing these valleys, the adhesive used to apply the backer to the cover portion, is given a greater surface area within which to flow in order to provide greater adhesion strength between the backer and the siding cover portion.

In FIG. 13A, the second side 404 of the backer of the present invention is shown in greater detail. In particular, FIG. 13A is a partial sectional view of the backer along line 13A-13A in FIG. 12. Ridges 408 are formed in the backer 400 to provide a ventilation space between the second side of the backer and the wall of a structure to which it is secured. These ridges 408 may be used in conjunction with water escape channels 410 to prevent moisture build-up in the paneling units. The ridges in a preferred embodiment may be about 0.045 inch high off the surface of the backer and about 0.5 inch wide. Larger or smaller ridges of various shapes are within the scope of the present invention. On the other hand, FIG. 13B is a partial sectional view of side 402 of the backer, which includes the aforementioned grooves or valleys 406 for receiving adhesive.

In FIG. 14, a recessed or relief zone 412 of the backer 400 is provided to enhance the fit between adjacent paneling units. By providing a slightly recessed zone of backer material an end of an adjacent backer may better overlap the recessed zone to provide an improved fit between adjacent backers. In a preferred embodiment of the present invention the recessed zone may be about 1.2784 inches long and about 0.100 inch wide along the profile. Larger or smaller relief zones of various shapes are within the scope of the present invention and may be formed into the backer at the same time the backer is being formed by use of a mold designed to the desired shape for example.

Figure 15:
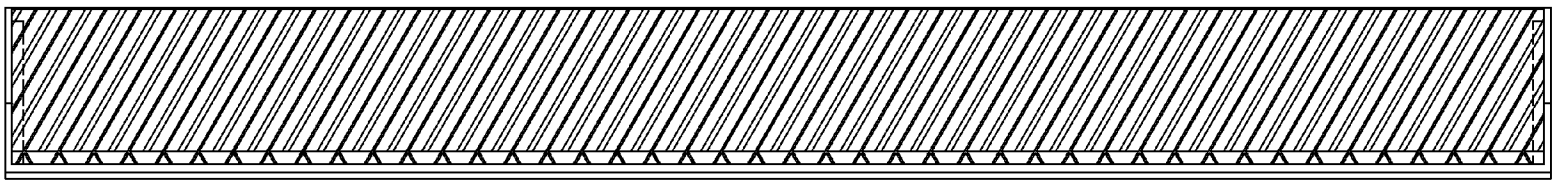
FIG. 15 is a rear elevation view of an exemplary embodiment of a paneling unit of the present invention.
Figure 16:
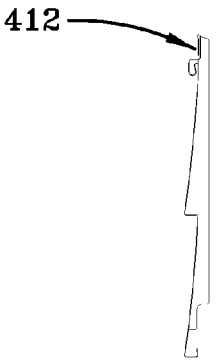
FIG. 16 is a side elevation view of an exemplary embodiment of an entire paneling unit that includes a relief zone.

As shown in FIG. 12, side 402 of backer 400 may also include at least one recessed or relief zone 414 to enhance the fit between adjacent paneling units. Relief zone 414 may be adapted to receive an edge of an adjacent facing panel to provide an improved lap joint. Optionally, relief zone 412 may be contiguous with relief zone 414. In this example, relief zone 414 starts approximately 1.250 inches from the top of the backer, and it is approximately 0.050 inch wide and approximately 2.0 inches deep. Nevertheless, larger or smaller relief zones of various shapes are within the scope of the present invention and may, for example, be formed into the backer at the same time the backer is being formed by use of a mold designed to the desired shape. Such as shown in FIG. 15, each edge of a backer may optionally include a relief zone similar to relief zone 414.

The top or face portion of the paneling units may be smooth or may have any number of finishes that are typically known by those in the art of manufacturing paneling. The finish may add contour and texture to simulate the appearance of wooden paneling.

The paneling units of the present invention may be of various lengths, heights, and thicknesses. The particular dimensions of a panel of the present invention may be selected to suit a particular application. Some exemplary embodiments of a paneling unit of the present invention may be approximately 15 to 18 inches in height. However, as just mentioned, it should also be recognized that a paneling unit of the present invention may have any desired dimensions including a height up to or in excess of 50 inches.

The paneling units as described herein may be formed from a polymer such as a vinyl material. Other materials such as polypropylene, polyethylene, other plastics and polymers, polymer composites (such as polymer reinforced with fibers or other particles of glass, graphite, wood, flax, other cellulosic materials, or other inorganic or organic materials), metals (such as aluminum or polymer coated metal), or other similar or suitable materials may also be used. The paneling may be molded, extruded, roll-formed from a flat sheet, or formed by any other suitable manufacturing technique.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A paneling unit for a wall of a structure, comprising:
a vinyl panel; and
a backing portion secured to said vinyl panel, said backing portion comprised of:
a first side adhered to and adjacent said vinyl panel;
a second side adapted to be situated adjacent to said wall; and
a first side end and a second side end for generally mating with adjacent paneling units,
wherein at least one of said side ends has a recess formed on said first side of said backing portion for receiving a side end of a vinyl panel of one of said adjacent paneling units to facilitate an overlapping relationship with a side end of said one of said adjacent paneling units;
wherein said first side comprises at least one valley filled with adhesive used in securing said backing portion to said vinyl panel.

2. The paneling unit of claim 1 wherein said backing portion is comprised of foamed plastic.

3. The paneling unit of claim 1 wherein said second side comprises at least one ridge for spacing said second side apart from said wall to enable ventilation between said backing portion and said wall once said paneling unit is secured to said wall.

4. The paneling unit of claim 1 wherein said at least one valley runs substantially horizontal along the length of said first side of said backing portion.

5. The paneling unit of claim 1 further comprising at least one water escape channel situated on said second side of said backing portion.

6. A paneling unit for a wall of a structure, comprising:
a vinyl panel; and
a backing portion secured to said vinyl panel, said backing portion comprised of:
a first side adhered to and adjacent said vinyl panel, said first side comprising at least one valley filled with adhesive used in securing said backing portion to said vinyl panel;

a second side adapted to be situated adjacent to said wall, said second side comprising at least one ridge for spacing said second side apart from said wall to enable ventilation between said backing portion and said wall once said paneling unit is secured to said wall; and a first side end and a second side end for generally mating with adjacent paneling units, wherein at least one of said side ends has a recess formed on said first side of said backing portion for receiving an edge of a vinyl panel of one of said adjacent paneling units to facilitate an overlapping relationship with a side end of said one of said adjacent paneling units.

7. The paneling unit of claim 6 further comprising at least one water escape channel situated on said second side of said backing portion.

* * * * *